US005233930A

United States Patent [19]

Wang

[11] Patent Number: 5,233,930

[45] Date of Patent: Aug. 10, 1993

[54] COLLAPSIBLE SHELF FOR BATHROOMS

[75] Inventor: Sung-Shun Wang, Tainan Hsien, Taiwan

[73] Assignee: San Ying Industrial Co., Ltd., Tainan Hsien, Taiwan

[21] Appl. No.: 926,636

[22] Filed: Aug. 10, 1992

[51] Int. Cl.[5] ..... A47B 23/00

[52] U.S. Cl. ..... 108/42; 211/186

[58] Field of Search ..... 108/42, 108, 109, 110; 211/186

[56] References Cited

U.S. PATENT DOCUMENTS 494,950 4/1893 Godfrey ..... 108/109
2,981,580 4/1961 Hansen ..... 108/42 X
3,785,301 1/1974 Lundqvist ..... 108/109
4,696,406 9/1987 Karashima ..... 108/110 X

*Primary Examiner*—Jose V. Chen
*Attorney, Agent, or Firm*—Morton J. Rosenberg; David I. Klein

[57] ABSTRACT

A collapsible shelf for bathrooms having a pair of hollow E-shaped frames, two deposit plates for putting things thereon and hanging rod unit for hanging towels or the like, the E-shaped frames respectively having a vertical portion and three horizontal portions extending from the vertical portion to assemble the two deposit plates and the rod unit between them by lateral side opposite grooves in the plates and the rod unit and a slot in each horizontal portion, and two lateral side rods in the plates and the rod unit fitting in hollow interiors of the vertical portions.

1 Claim, 4 Drawing Sheets

COLLAPSIBLE SHELF FOR BATHROOMS

BACKGROUND OF THE INVENTION

A conventional shelf for bathrooms shown in FIG. 4, comprises a pair of E-shaped frames 10, two deposit plates 20, and a hanging rod unit 103. The E-shaped frames respectively have a vertical portion and three horizontal portions extending from the vertical portion. Each horizontal portion has two holes for screws 104 to pass through to engage holes 201 in the deposit plates 20 and the hanging rod unit 103 so that the deposit plates 20 and the rod unit 103 are assembled with the E-shaped frames 10. Then a cap 105 is covered on each hole to shield the screw 104.

The conventional shelf for bathrooms has been found to have the following disadvantages.

1. As the E-shaped frames and the deposit plates and the hanging rod units are assembled together with screws, it takes much time to assemble them together.

2. The holes for screws in the E-shaped frames and screw holes in the plates and the rod unit are liable to split and may become functionally inoperative.

3. The screws and the caps may rust and become difficult to remove for repair after a period of use.

SUMMARY OF THE INVENTION

In view of the disadvantages that the conventional shelf for bathrooms has, this invention has been devised to improve prior art shelves and provide the following advantages:

1. The subject shelf is collapsible and may be easily assembled without using screws.

2. The subject shelf when broken may be easily components replaced by new ones quickly.

3. The subject shelf is inexpensively transported as it can be collapsed for transportation thereby saving space.

The collapsible shelf for bathrooms in the present invention, comprises a pair of hollow E-shaped frames, two deposit plates for putting things thereon, and a hanging rod unit for hanging towels or the like. The hollow E-shaped frames have a vertical portion and three horizontal portions extending from the vertical portion. The horizontal portions are assembled with the deposit plates and the hanging rod unit by means of slots in the horizontal portions and a pair of lateral straight opposite grooves in the deposit plates and the hanging rod unit to fit with each other. The deposit plates and the hanging rod unit have respectively a lateral side square ridge to fit in a hollow interior of the horizontal portions so as to keep the deposit plates and the hanging rod unit securely assembled with the E-shaped frames.

BRIEF DESCRIPTION OF DRAWINGS

The invention will be better understood by reference to the accompanying drawings, wherein.

DETAILED DESCRIPTION OF THE INVENTION

Figure 1:
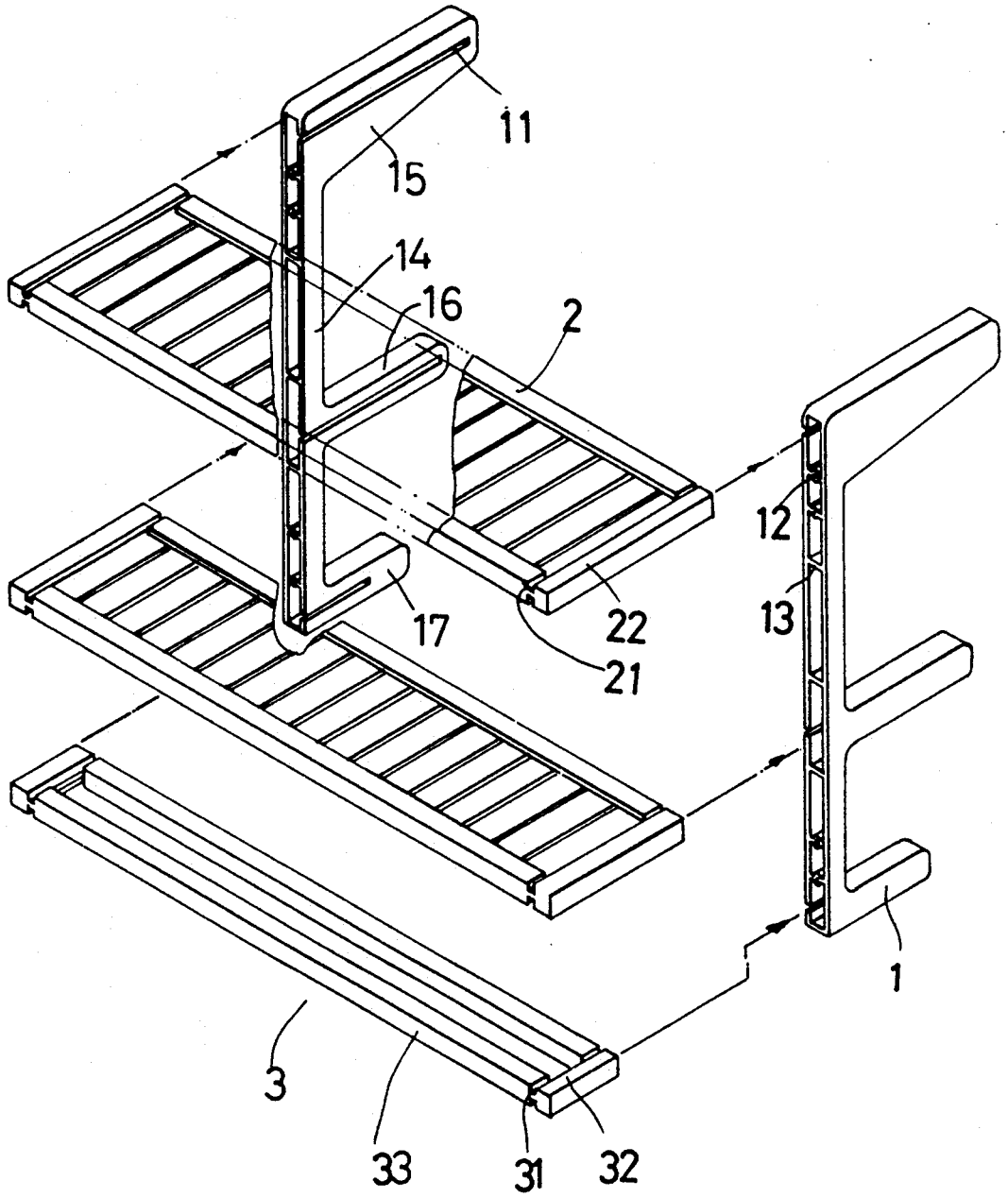
FIG. 1 is an exploded perspective view of a collapsible shelf for bathrooms in the present invention.
Figure 2:
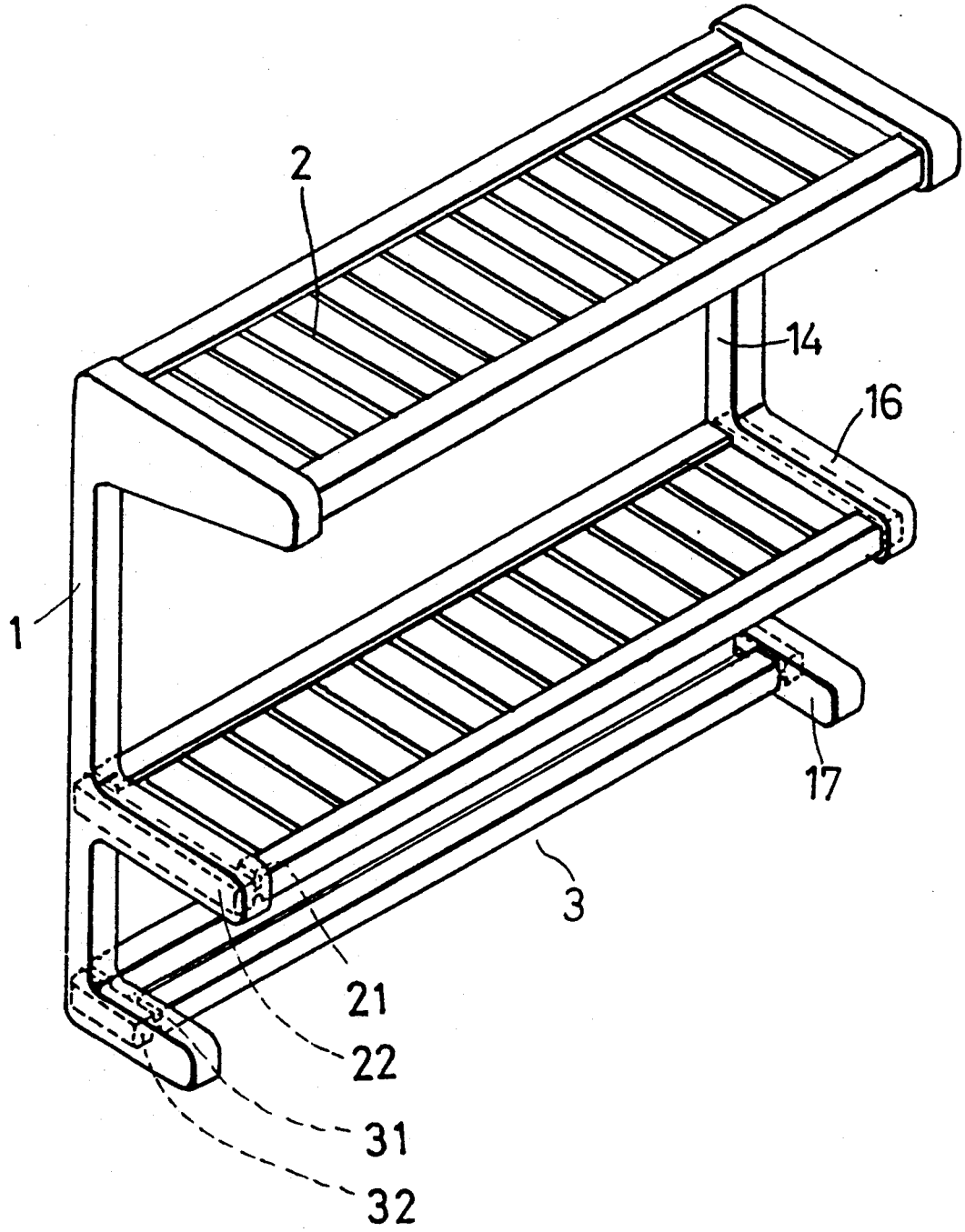
FIG. 2 is a perspective view of the collapsible shelf for bathrooms in the present invention.
Figure 3:
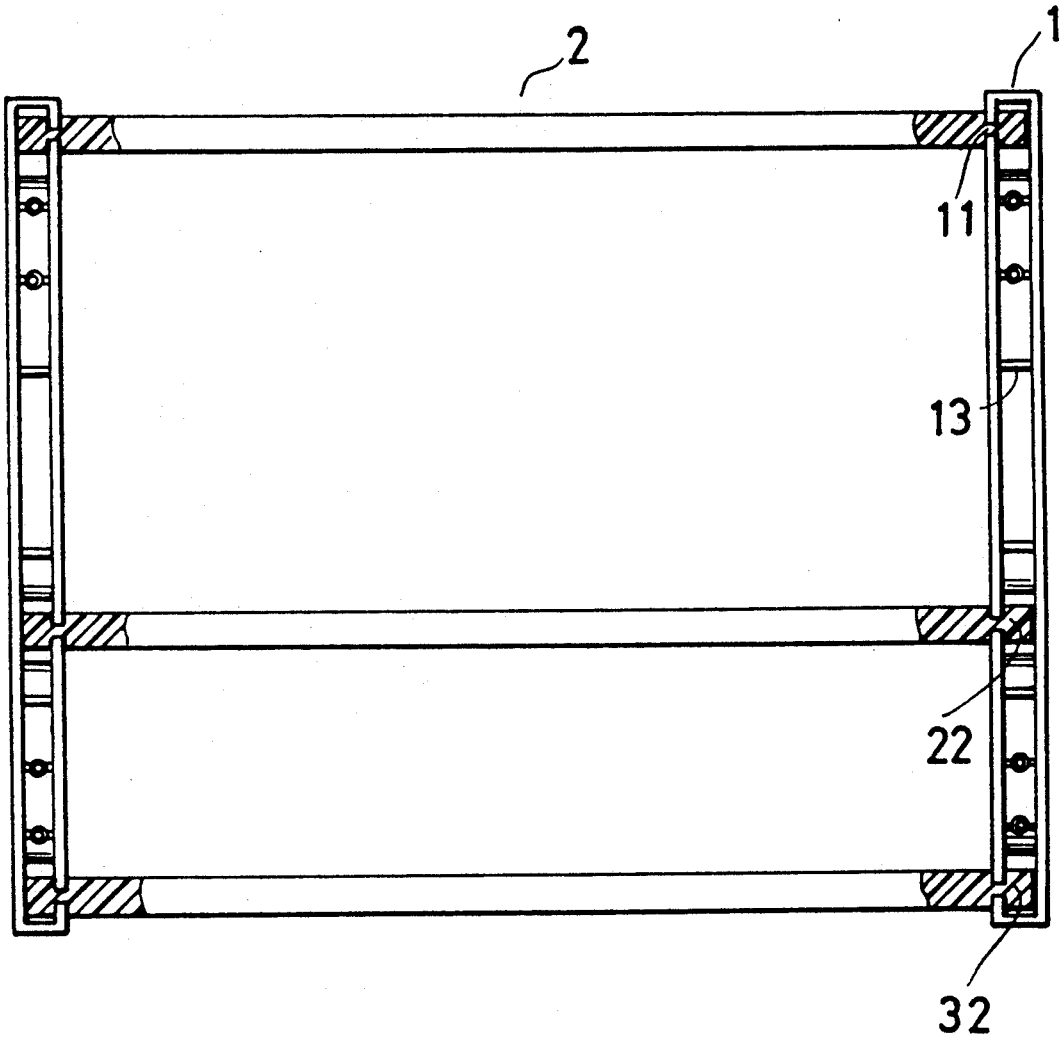
FIG. 3 is a rear view of the collapsible shelf for bathrooms in the present invention; and, FIG. 4 is an exploded view of a conventional shelf for bathrooms.
Figure 4:
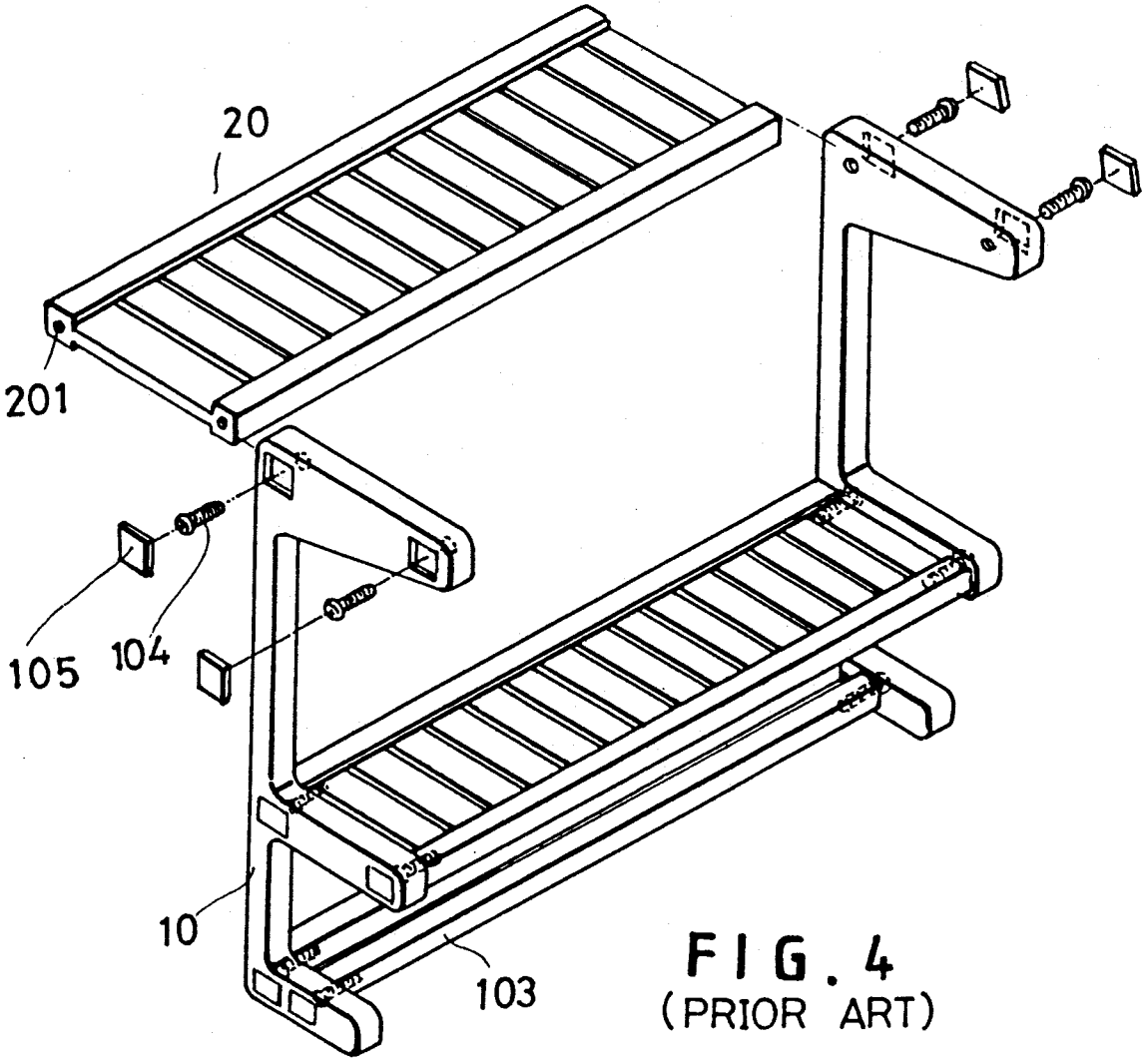
FIG. 4 (PRIOR ART)

A collapsible shelf for bathrooms in the present invention, as shown in FIG. 4, comprises two hollow E-shaped frames 1, 1, two flat deposit plates 2, 2, and a hanging rod unit 3.

The hollow E-shaped frames 1, 1 have a vertical portion 14 of a square cross-section and three horizontal parallel portions 15, 16, 17 of a square cross-section extending from the vertical portion 14, and the three horizontal portions 15, 16, 17 are respectively provided with a lengthwise slot 11 for the deposit plates 2, 2 to combine with. The vertical portion 14 has a plurality of lateral reinforcing ribs 13 properly spaced apart in its hollow interior to reinforcing the vertical portion 14. And a plurality of screws holes 12 are provided in the hollow interior of the vertical portion 14, passing through from a front surface to a rear surface for screws to pass through to fix the shelf on a wall.

The flat deposit plates 2, 2, are for putting things thereon, being combined with the two E-shaped frames 1, 2 between an upper and an intermediate horizontal portions 15, 16, and having a pair of lateral opposite straight grooves 21 respectively in both lateral sides and a square lateral side rod 22 abutting the pair of lateral grooves 21. The two pairs of lateral opposite straight grooves 21 engage upper and lower walls defining the lengthwise slots 11 in the horizontal portions 15, 16 and the square side rods 22 fit in the hollow interior of the vertical portion 14.

The hanging rod unit 3 has two or more lengthwise rods 33 and two lateral square side end rods 32 formed together with a pair of lateral opposite straight grooves 31 abutting the end rods 32. The pair of lateral straight grooves 31 engage upper and lower walls defining the lengthwise slots 11 in the lower horizontal portion 17 of the E-shaped frame 1 and the square lateral side rods 32 fit in the hollow interior of a lower horizontal portion so that the rod unit 3 may be combined with the E-shaped frame 1 for hanging towels or the like on the rods 33.

In assembling this collapsible shelf, the deposit plates 2, 2 are first to be combined with the E-shaped frames 1, 1 by engaging the two pairs of lateral opposite straight grooves 21 with the upper and lower walls defining the lengthwise slots 11, 11 in the upper and the intermediate horizontal portions 15, 16 and the square lateral side rods 22 fitting in the hollow interior of the horizontal portions 15, 16. Then the rod unit 3 is to be combined with the E-shaped frames 1, 1 by engaging the two pairs of lateral opposite straight grooves 31 with the walls defining the lengthwise slot 11, 11 in the lower horizontal portions 17, 17 and fitting the square lateral side rods 32, 32 in the hollow interior of the lower horizontal portions 17, 17 of the E-shaped frames 1, 1. Lastly screws are used to fix this assembled shelf on a wall passing through the screw holes 12 provided in the vertical portions 14 of the E-shaped frames 1, 1.

While the preferred embodiments of the invention have been described above, it will be recognized and understood that various modifications may be made therein and the appended claims are intended to cover all such modifications which may fall within the spirit and scope of the invention.

What is claimed is:

1. A collapsible shelf for bathrooms comprising:

a pair of E-shaped frames, each of said E-shaped frames having a hollow vertical portion and three hollow horizontally directed portions extending from the vertical portion, said horizontal portions respectively having a lengthwise slot formed therein, said vertical portion having a plurality of spaced apart reinforcing ribs located therein and a plurality of screw holes formed therethrough for screws to pass through to fixedly couple said shelf on a wall;

a pair of flat deposit plates mounted to said E-shaped frames, each of said flat deposit plates having a pair of lateral side square straight grooves formed therein and a lateral side square rod abutting said grooves respectively on opposing lateral sides of each of said flat deposit plates;

a hanging rod unit having a pair of laterally directed rods for hanging objects therefrom, said hanging rod unit having a pair of lateral side square rods and a pair of vertically opposed straight grooves abutting a respective square rod; and said deposit plates being coupled to said E-shaped frames by insert of said lateral side square rods of said flat deposit plates within said hollow vertical portions of said respective E-shaped frames, said E-shaped frame lengthwise slots being cooperatively positioned with respect to said respective lateral side square straight grooves formed within said flat deposit plates.

* * * * *